US008801223B2

(12) United States Patent
Hsieh et al.

(10) Patent No.: US 8,801,223 B2
(45) **Date of Patent: *Aug. 12, 2014**

(54) LED LAMP

(71) Applicants: Kuan-Hong Hsieh, Miaoli (TW); Te-Sheng Chen, Miaoli (TW); Wen-Hsiang Lu, Miaoli (TW); Bo-Yong Yang, Shanghai (CN); Liang Yi, Shanghai (CN); Yu Zhang, Shanghai (CN)

(72) Inventors: Kuan-Hong Hsieh, Miaoli (TW); Te-Sheng Chen, Miaoli (TW); Wen-Hsiang Lu, Miaoli (TW); Bo-Yong Yang, Shanghai (CN); Liang Yi, Shanghai (CN); Yu Zhang, Shanghai (CN)

(73) Assignees: Foxsemicon Integrated Technology (Shanghai) Inc., Shanghai (CN); Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/726,637

(22) Filed: Dec. 26, 2012

(65) Prior Publication Data

US 2013/0170183 A1 Jul. 4, 2013

(30) Foreign Application Priority Data

Dec. 28, 2011 (CN) ..... 2011 1 0446942

(51) Int. Cl.
*F21S 4/00* (2006.01)

(52) U.S. Cl.
USPC ..... 362/249.02; 362/231; 362/249.06

(58) Field of Classification Search
USPC ..... 362/249.02, 231, 294, 249.06
See application file for complete search history.

(56) References Cited

U.S. PATENT DOCUMENTS

| | | | | |
|---|---|---|---|---|
| 7,845,832 | B2 * | 12/2010 | Boyer | 362/294 |
| 8,018,136 | B2 * | 9/2011 | Gingrich et al. | 313/498 |
| 8,197,089 | B2 * | 6/2012 | Chang et al. | 362/249.02 |
| 2006/0164831 | A1 * | 7/2006 | Lai | 362/231 |
| 2011/0211351 | A1 * | 9/2011 | Van De Ven et al. | 362/249.02 |
| 2011/0291588 | A1 * | 12/2011 | Tagare | 315/294 |
| 2013/0063945 | A1 * | 3/2013 | Wu et al. | 362/249.02 |

* cited by examiner

*Primary Examiner* — Peggy Neils
(74) *Attorney, Agent, or Firm* — Novak Druce Connolly Bove + Quigg LLP

(57) ABSTRACT

An LED lamp includes a socket and a shallow dish-shaped body detachably connected to the socket. The socket is electrically connected to an external power source. The body includes a rear cover, a transparent front cover, a lamp board, a number of LED light sources, a driving circuit board and a fixing member. The LED light sources are mounted on the lamp board facing the front cover, wherein the LED light sources are visible from an outside of the transparent front cover when they are lit. The driving circuit board is electrically connected to the socket and the lamp board, and is configured for driving the LED light sources to emit light beams. The fixing member is configured for fixing the rear cover, the driving circuit board and the lamp board together.

7 Claims, 11 Drawing Sheets

LED LAMP

BACKGROUND

1. Technical Field

The present disclosure relates to illumination devices and, particularly, to an light-emitting diode (LED) lamp with a flat shape and can be received by existing bulb seat.

2. Description of Related Art

Light-emitting diodes (LEDs) are becoming increasingly prevalent for a variety of lighting functions. However, existing incandescent bulbs have been used for many years, and it will be a great waste to abandon those bulb seats which have already been installed everywhere, when LED lighting devices replace these existing incandescent bulbs.

Therefore, an LED lamp which can be received in existing bulb seat, and can be applied to many fields, such as being used as a mood light, traffic light, or warning light, is needed.

BRIEF DESCRIPTION OF THE DRAWINGS

Many aspects of the embodiments can be better understood with reference to the following drawings. The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
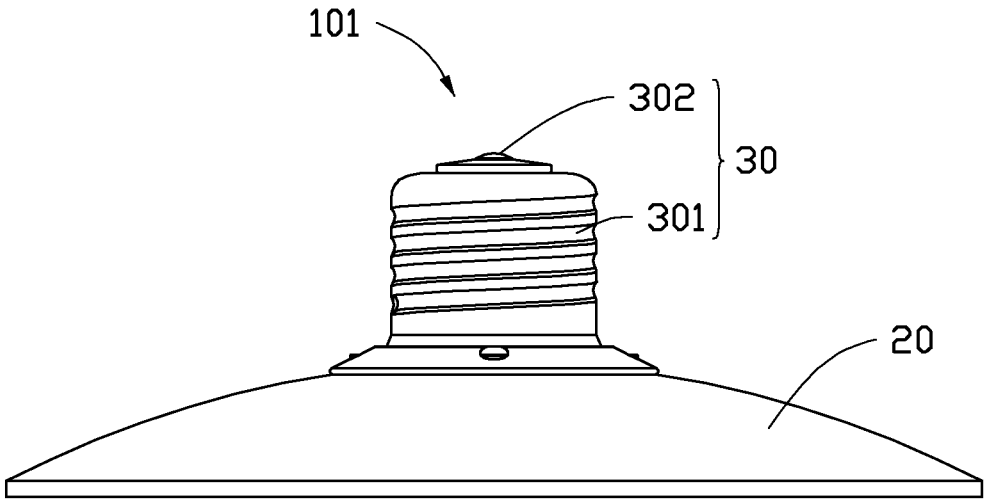
FIG. 1 is a schematic, isometric view of an LED lamp according to a first embodiment.

Referring to FIG. 1, a flat LED lamp 101 according to a first embodiment is illustrated. The LED lamp 101 includes a shallow dish-shaped body 20 and a socket 30 detachably connected to the body 20. In the first embodiment, a first electrical contact 302 is formed on a distal end portion of the socket 30, and an outer screw thread 301 functioning as a second electrical contact is formed on an external surface of the socket 30. The first electrical contact 302 and the second electrical contact 301 are configured to be electrically connected to a positive terminal and a negative terminal of an external DC or AC power source (not shown) correspondingly. The LED lamp 101 is assembled to a bulb seat (not shown) through the socket 30, therefore the external power source can supply power to the LED lamp 101. In the embodiment, the socket 30 is selected from a standard E27 socket and a standard E26 socket.

Figure 2:
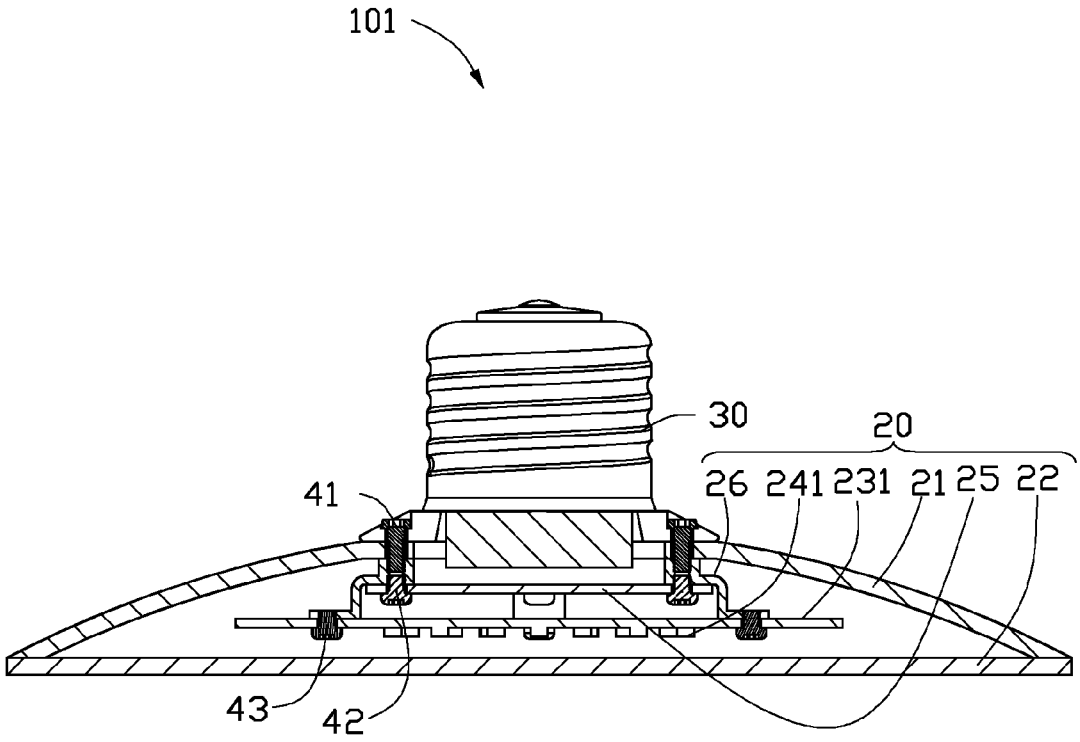
FIG. 2 is a partial, cross-sectional view of the LED lamp of FIG. 1, which includes a fixing member.

Referring to FIG. 2, in the first embodiment, the body 20 and the socket 30 are assembled together by insertions of a number of bolts 41 into a number of through holes defined in the body 20 and the socket 30. In an alternative embodiment, the body and the socket 30 can be screwed together by engagement of screw threads formed in an external surface of the body 20 and an internal lateral surface of the socket 30.

The body 20 includes a rear cover 21, a front cover 22, a lamp board 231, a number of LED light sources 241, a driving circuit board 25 and a fixing member 26. The fixing member 26 is configured for fixing the rear cover 21, the driving circuit board and the lamp board 231 together. The rear cover 21 can be screwed to or fastened to the front cover 22.

Figure 3:
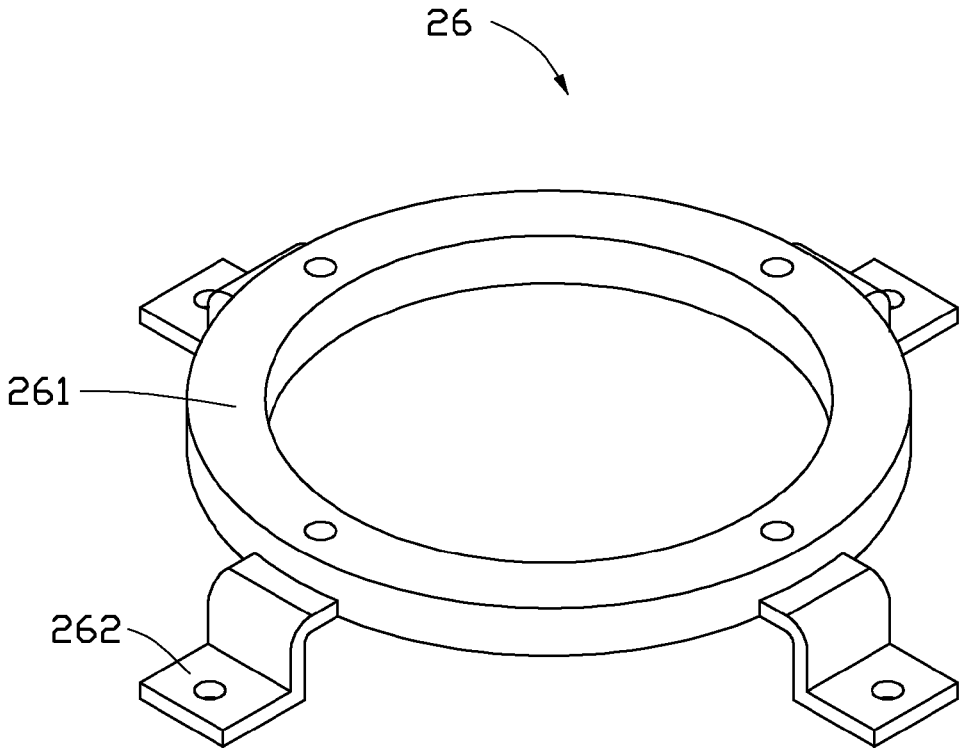
FIG. 3 is a schematic, isometric view of the fixing member of FIG. 2.

Referring also to FIG. 3, in the first embodiment, the fixing member 26 includes a ring-shaped first fixing element 261 and a number of paws 262 extending radially and outwardly from the first fixing element 261. The first fixing element 261 defines a number of mounting holes for passing through a number of bolts 42 to fix the rear cover 21 and the driving circuit board 25 to the fixing member 26. Each paw 262 defines a mounting hole for passing through a bolt 43 to fix the lamp board 231 to the fixing member 26. In the first embodiment, the lamp board 231 parallels to the front cover 22.

A voltage input terminal of the driving circuit board 25 is electrically connected to the socket 30, and a voltage output terminal of the driving circuit board 25 is electrically connected to the lamp board 231. The driving circuit board 25 is configured for converting an external relative higher alternate voltage to a relative lower direct voltage, to drive the LED light sources 241 to emit light beams.

Figure 4:
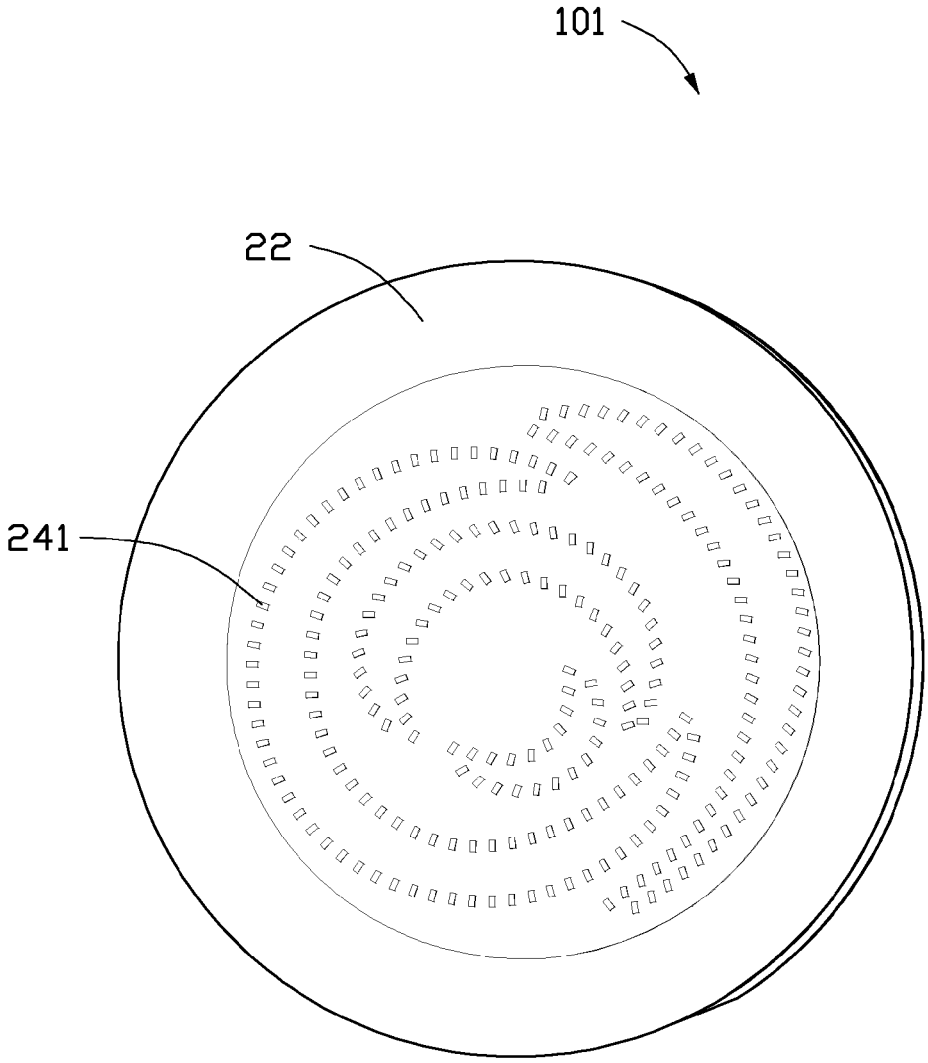
FIG. 4 is a schematic view showing an emitting surface of the LED lamp of FIG. 2.

Referring again to FIG. 2, in the first embodiment, the LED light sources 241 are mounted on the lamp board 231 facing an inside of the front cover 22. Referring also to FIG. 4, in the first embodiment, the front cover 22 is made of transparent material. The LED light sources 241 are configured for emitting multicolor light beams, and arranged in a given pattern, such as flowers, animals, stars, and so on, and are visible from an outside through the transparent front cover 22 when the LED light sources 241 are lit. In use, the driving circuit board 25 drives the LED light sources 241 to emit multicolor light beams, and the multicolor light beams and the pattern of the arrangement of the LED light sources 241 are visible from the outside of the transparent front cover 22, to meet the needs of mood lighting.

In other embodiments, the LED light sources 241 are arranged in a number of different groups for respectively emitting light beams with different colors, and each group of the LED light sources are arranged in a given pattern. The driver 25 is configured for selectively driving one group of the LED light sources 241 to emit light beams, to present an intended given pattern, or driving a plurality of the at least one groups of the LED light sources 241 to sequentially emit light beams, to sequentially present multiple intended given patterns, in order to meet different needs of users at different times and different scenes.

Figure 5:
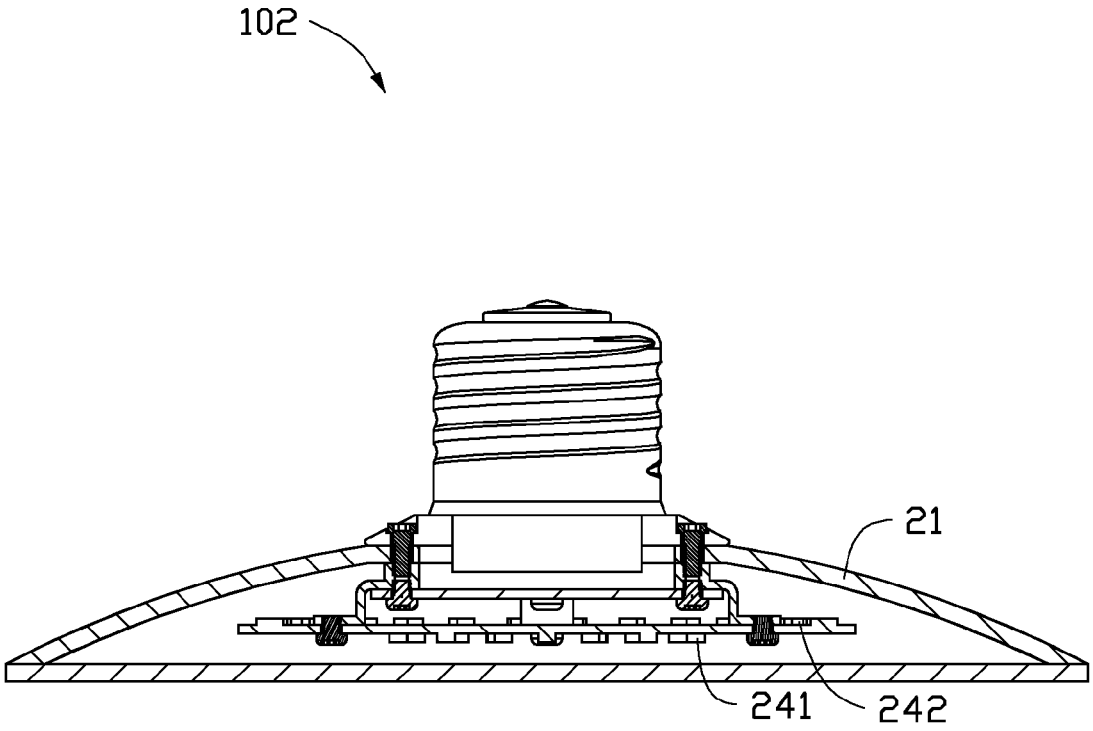
FIG. 5 is a partial, cross-sectional view of the LED lamp of FIG. 1 according to a second embodiment.

In a second embodiment, as shown in FIG. 5, the LED lamp 102 further includes a number of rear LED light sources 242 mounted on a rear side of the lamp board 231 facing the rear cover 21. In the second embodiment, at least a part of the rear cover 21 is made of transparent material, and the rear LED light sources 242 are configured to emit light beams towards the rear cover 21, in order to eliminate a dark area formed on the top of the LED lamp 102.

Figure 6:
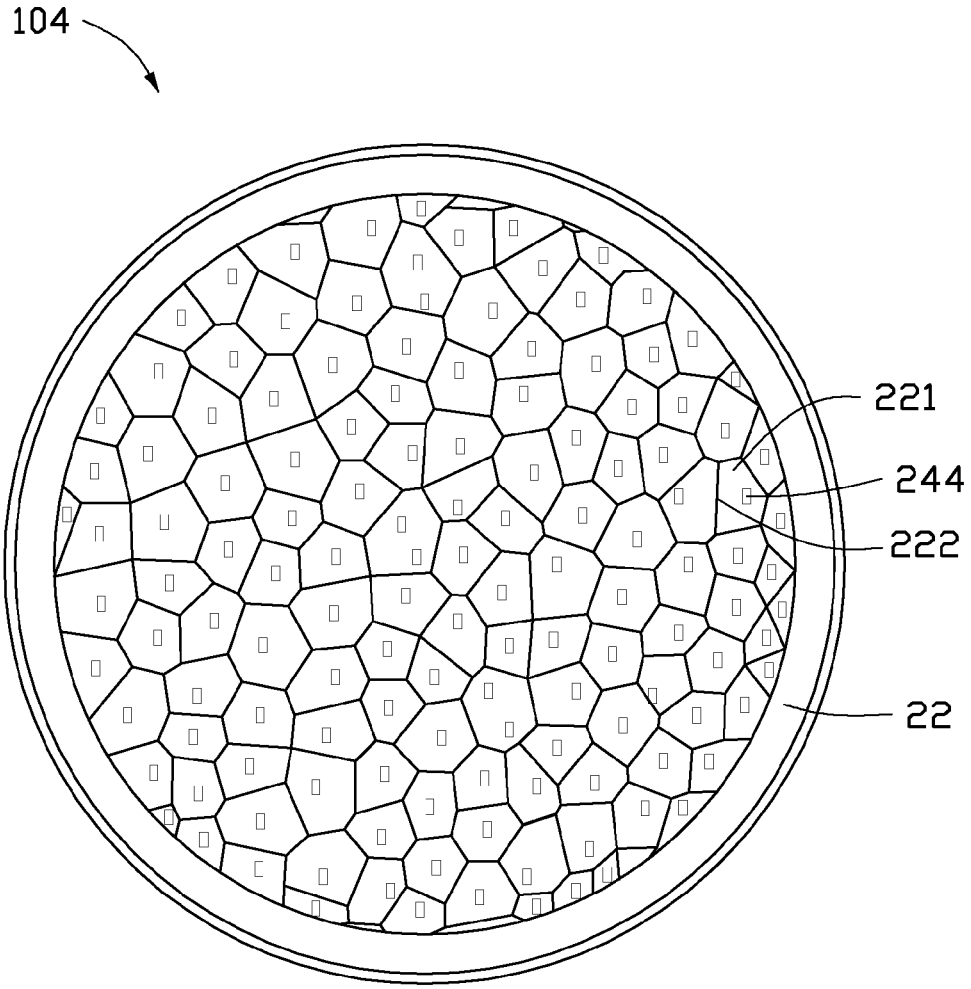
FIG. 6 is a schematic view showing an emitting surface of the LED lamp of FIG. 1 according to a third embodiment.

In a third embodiment, as shown in FIG. 6, the transparent front cover 22 has a honeycombed pattern including a plurality of cells 221. Each LED light source 244 is configured to emit a light beam toward the front cover 22 so as to create a light spot in corresponding cell 221 on the front cover 22. In the third embodiment, the cells 221 have different shapes.

In the third embodiment, a number of stripes 222 are etched on a surface of the front cover 22, to form boundaries of the cells 221, and a number of colored films with different colors are respectively formed on those cells 221. In use, the driving circuit board 25 drives the LED light sources 244 to emit white light beams, and the films are configured to convert the white light into light beams with different colors. In other embodiment, a number of different multicolor and transparent glasses are spliced to form the multicolor cells 221. In use, the driving circuit board 25 drives the LED light sources 244 to emit white light beams, and the white light beams pass through the multicolor cells 221 to form multicolor spots on the surface of the LED lamp 104.

In an alternative embodiment, the LED light sources 244 are divided into a number of different groups for respectively emitting light with different colors. Each group of the LED light sources 244 are arranged in a given pattern. In use, each group LED light sources 244 emit their specific color light beams, and are shown outside a crystal visual effect through the transparent front cover 22.

Figure 7:
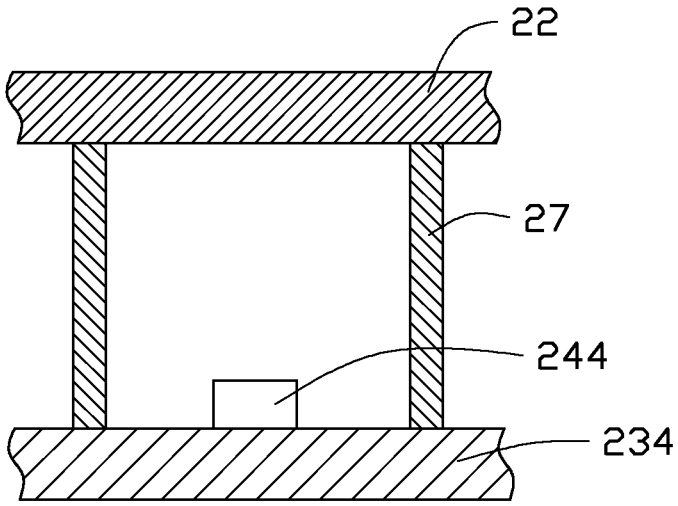
FIG. 7 is a partial, cross-sectional view of the LED lamp of FIG. 6.
Figure 8:
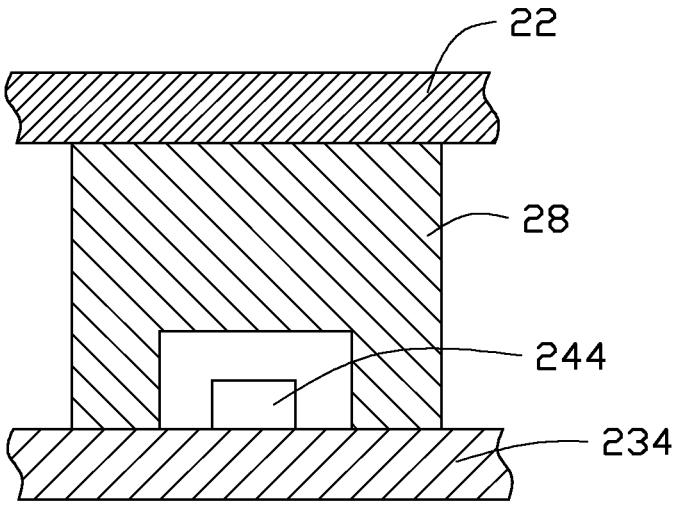
FIG. 8 is another partial, cross-sectional view of the LED lamp of FIG. 6.

In other embodiment, a light guiding plate 27 as shown in FIG. 7 or a lens block 28 as shown in FIG. 8, is arranged between each group of the LED light sources 244 and the front cover 22. Adjoining interfaces of adjacent light guiding plates 27 or adjacent lens block 28 form boundaries of the cells 221. The light guiding plates 27 or the lens blocks 28 are configured to guide the light beams from the LED light sources 244 respectively to the corresponding cells 221, in order to form corresponding multicolor spots on the surface of the LED lamp 104. With such structure, makers only need to determine the arrangement of the LED light sources or change the surface of the covers, the driving circuit board 25 can then simply drive the LED light sources to emit their light beams to reach a multicolor and crystal visual effect with non-light mixing driving process, therefore no complicated driving circuits or processes is needed.

Figure 9:
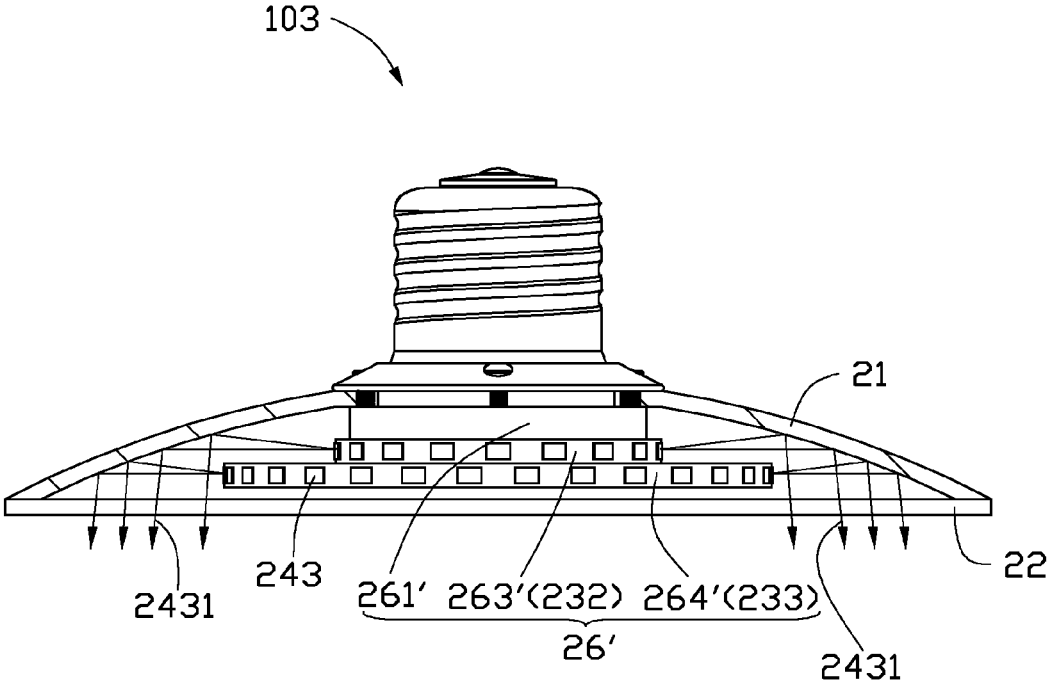
FIG. 9 is a partial, cross-sectional view of the LED lamp of FIG. 1 according to a fourth embodiment.
Figure 10:
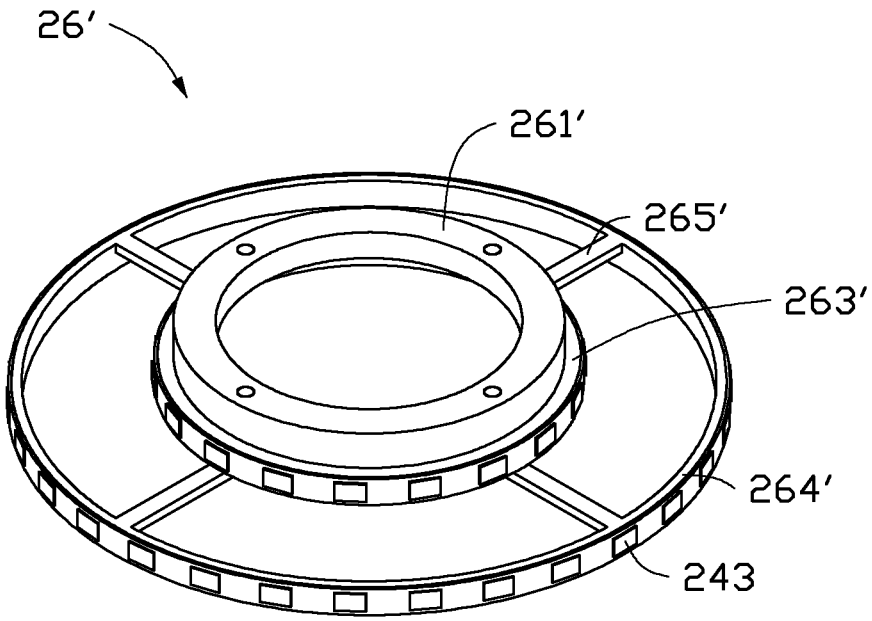
FIG. 10 is a schematic, isometric view of the fixing member of FIG. 9.

In a fourth embodiment, as shown in FIGS. 9 and 10, the fixing member 26' is shaped like a stepped pyramid, and includes the first ring-shaped fixing element 261', a second ring-shaped fixing element 263' and a third ring-shaped fixing element 264'. In the fourth embodiment, the lamp boards 232 and 233 are respectively mounted on the external circumferential surfaces of the second fixing element 263' and the third fixing element 264'. With such structure, the LED light sources 243 are mounted on the lamp boards 232 and 233 facing the inside of the rear cover 21 and emit light beams 2431 towards the rear cover 21. In the fourth embodiment, the rear cover 21 has a reflecting internal surface, which can be coated with reflective film, or made of reflective material. The rear cover 21 is configured for allowing a portion of the light beams from the LED light sources 243 to pass therethrough and reflecting remaining portion of the light beams to the front cover 22, and the front cover 22 is configured for allowing the reflected light beams to pass therethrough.

In the fourth embodiment, the first fixing element 261', the second fixing element 263' and the third fixing element 264' are concentric rings, the first fixing element 261' protrudes from the second fixing element 263', and the third fixing element 264' is connected to the second fixing element 263' via a number of ribs 265', the ribs 265' are evenly spaced from each other and extend radially and outward from the external circumferential surface of the second fixing element 263'.

Figure 11:
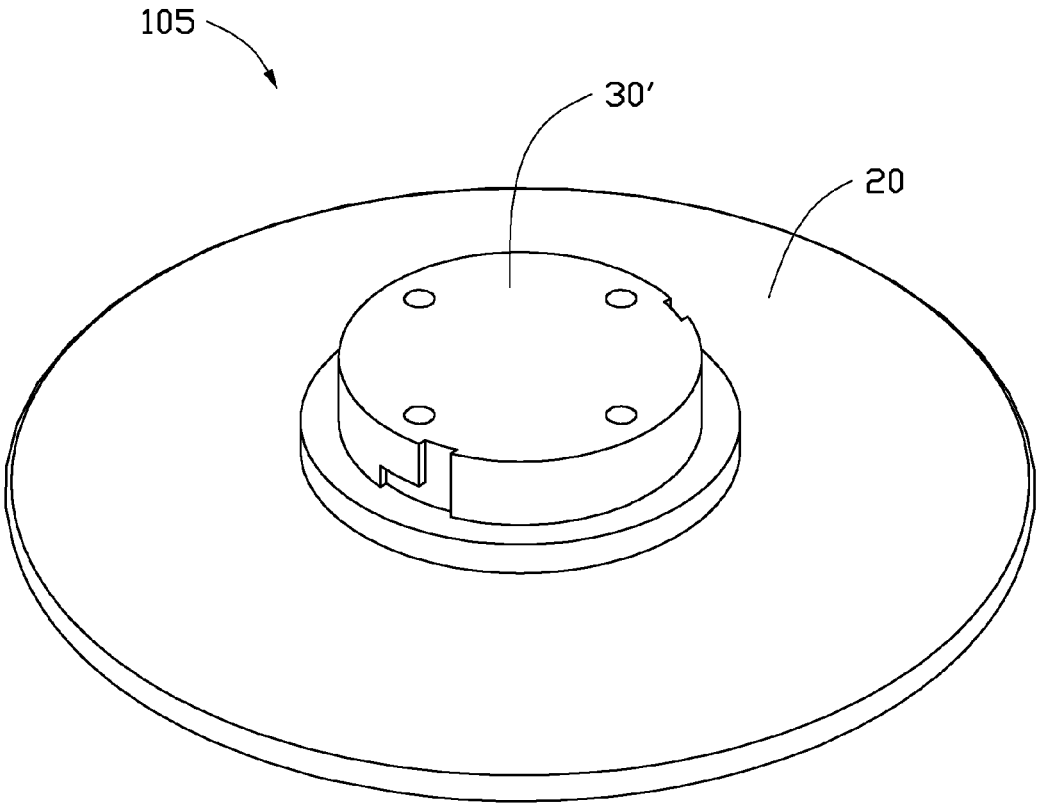
FIG. 11 is a schematic, isometric view of the LED lamp according to a fifth embodiment.

In a fifth embodiment, as shown in FIG. 11, the socket 30' has a flat shape, such as the GX53 socket. In other embodiment, the socket 30' is a bayonet type socket which can be received in the existing common bulb seat.

Moreover, it is to be understood that the disclosure may be embodied in other forms without departing from the spirit thereof. Thus, the present examples and embodiments are to be considered in all respects as illustrative and not restrictive, and the disclosure is not to be limited to the details given herein.

What is claimed is:

1. A light emitting diode (LED) lamp comprising:

a socket for insertion in a bulb seat thus being electrically connected to an external power source; and a shallow dish-shaped body detachably connected to the socket, the body comprising:

a rear cover;

a transparent front cover;

a lamp board parallel to the front cover;

a plurality of LED light sources mounted on the lamp board facing an inside of the front cover, wherein the LED light sources are visible from an outside of the transparent front cover when the LED light sources are lit; and a plurality of rear LED light sources mounted on a rear side of the lamp board facing the rear cover, wherein at least a part of the rear cover is made of transparent material, and the rear LED light sources are configured to emit light beams towards the rear cover;

a driving circuit board electrically connected to the socket and the lamp board, the driving circuit board configured for driving the LED light sources to emit light beams; and a fixing member configured for fixing the rear cover, the driving circuit board and the lamp board together.

2. The LED lamp of claim 1, wherein the LED light sources are arranged in a plurality of different groups for respectively emitting light beams with different colors, and each group of the LED light sources are arranged in a given pattern.

3. The LED lamp of claim 2, wherein the driving circuit board is configured for selectively driving a group of the LED light sources to emit light beams, to present an intended given pattern, or driving a plurality of the groups of the LED light sources to sequentially emit light beams, to sequentially present multiple intended given patterns.

4. The LED lamp of claim 1, wherein the fixing member comprises a first ring-shaped fixing element and a plurality of paws extending radially and outwardly from the first fixing element, wherein the first fixing element is configured for fixing the rear cover and the driving circuit board to the fixing member, and the paws are configured for fixing the lamp board to the fixing member.

5. The LED lamp of claim 1, wherein the rear cover is screwed to or fastened to the front cover.

6. The LED lamp of claim 1, wherein a first electrical contact is formed on a distal end portion of the socket, and an outer screw thread functioning as a second electrical contact is formed on an external surface of the socket, the first electrical contact and the second electrical contact are configured to be electrically connected to the external power source.

7. The LED lamp of claim 1, wherein the socket is selected from a standard E27 socket, a standard E26 socket, a GX53 socket, or a bayonet type socket.

* * * * *